US012522897B2

(12) United States Patent
Chen et al.

(10) Patent No.: US 12,522,897 B2
(45) Date of Patent: Jan. 13, 2026

(54) PREPARATION METHOD OF LIGHT METAL/BORON CARBIDE COMPOSITE MATERIAL

(71) Applicant: NATIONAL CHUNG SHAN INSTITUTE OF SCIENCE AND TECHNOLOGY, Taoyuan (TW)

(72) Inventors: Yen-Chung Chen, Taoyuan (TW); Ker-Jer Huang, Taoyuan (TW); Chuen-Ming Gee, Taoyuan (TW); Wei-Ting Hsu, Taoyuan (TW)

(73) Assignee: NATIONAL CHUNG SHAN INSTITUTE OF SCIENCE AND TECHNOLOGY, Taoyuan (TW)

( * ) Notice: Subject to any disclaimer, the term of this patent is extended or adjusted under 35 U.S.C. 154(b) by 1026 days.

(21) Appl. No.: 17/583,234

(22) Filed: Jan. 25, 2022

(65) Prior Publication Data

US 2023/0235431 A1 Jul. 27, 2023

(51) Int. Cl.

| | |
|---|---|
| ***C22C 29/06*** | (2006.01) |
| ***C22F 1/00*** | (2006.01) |
| ***C22F 1/02*** | (2006.01) |

(52) U.S. Cl.

CPC ..... *C22C 29/067* (2013.01); *C22C 29/062* (2013.01); *C22F 1/00* (2013.01); *C22F 1/02* (2013.01)

(58) Field of Classification Search

CPC ..... C22C 29/067; C22C 29/062; C22C 1/053; C22C 32/0057; C22C 1/1084; C22C 1/0408; C22C 1/0416; C22C 1/0458; C22C 1/05; C22F 1/00; C22F 1/02; B22F 2003/185; B22F 2998/10; B22F 2999/00; B22F 3/04; B22F 3/14; B22F 3/18; B22F 1/065; B22F 1/068; B22F 3/10

See application file for complete search history.

(56) References Cited

U.S. PATENT DOCUMENTS

2017/0152191 A1* 6/2017 Keller ..... C04B 35/591

OTHER PUBLICATIONS

Guo et al.; "Strengthening and toughening B4C/Al composites via optimizing the Al2O3 distribution during hot rolling"; Jan. 13, 2022; Journal of Alloys and Compounds 902, pp. 1-15 (Year: 2022).*

* cited by examiner

*Primary Examiner* — Adil A. Siddiqui

(57) ABSTRACT

The present invention provides a preparation method of a light metal/boron carbide composite material, comprising: (A) providing a boron carbide precursor and a light metal powder to perform a pretreatment mixing process to form a precursor; (B) performing a vacuum hot pressing molding or a vacuum cold isostatic pressing molding on the precursor to make the precursor form a light metal/boron carbide compound green body that is uniform; (C) performing a thermal treatment on the light metal/boron carbide compound green body to make the light metal/boron carbide compound green body form a light metal/boron carbide compound sintered body; and (D) performing a cold rolling treatment or a hot rolling treatment on the light metal/boron carbide compound sintered body to obtain a light metal/boron carbide composite material.

6 Claims, 1 Drawing Sheet

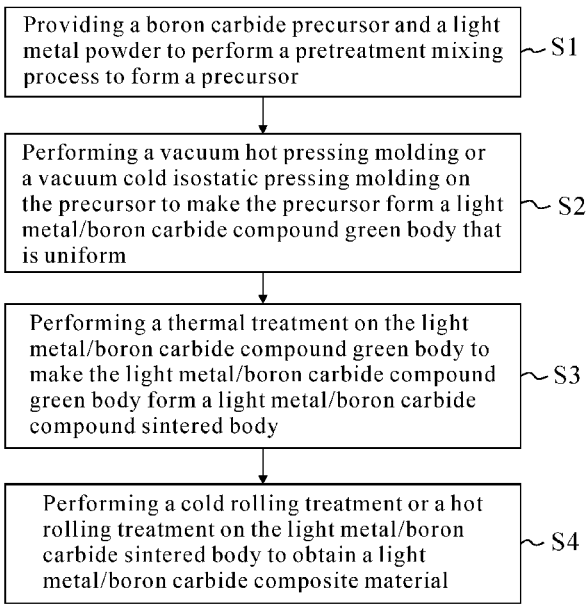

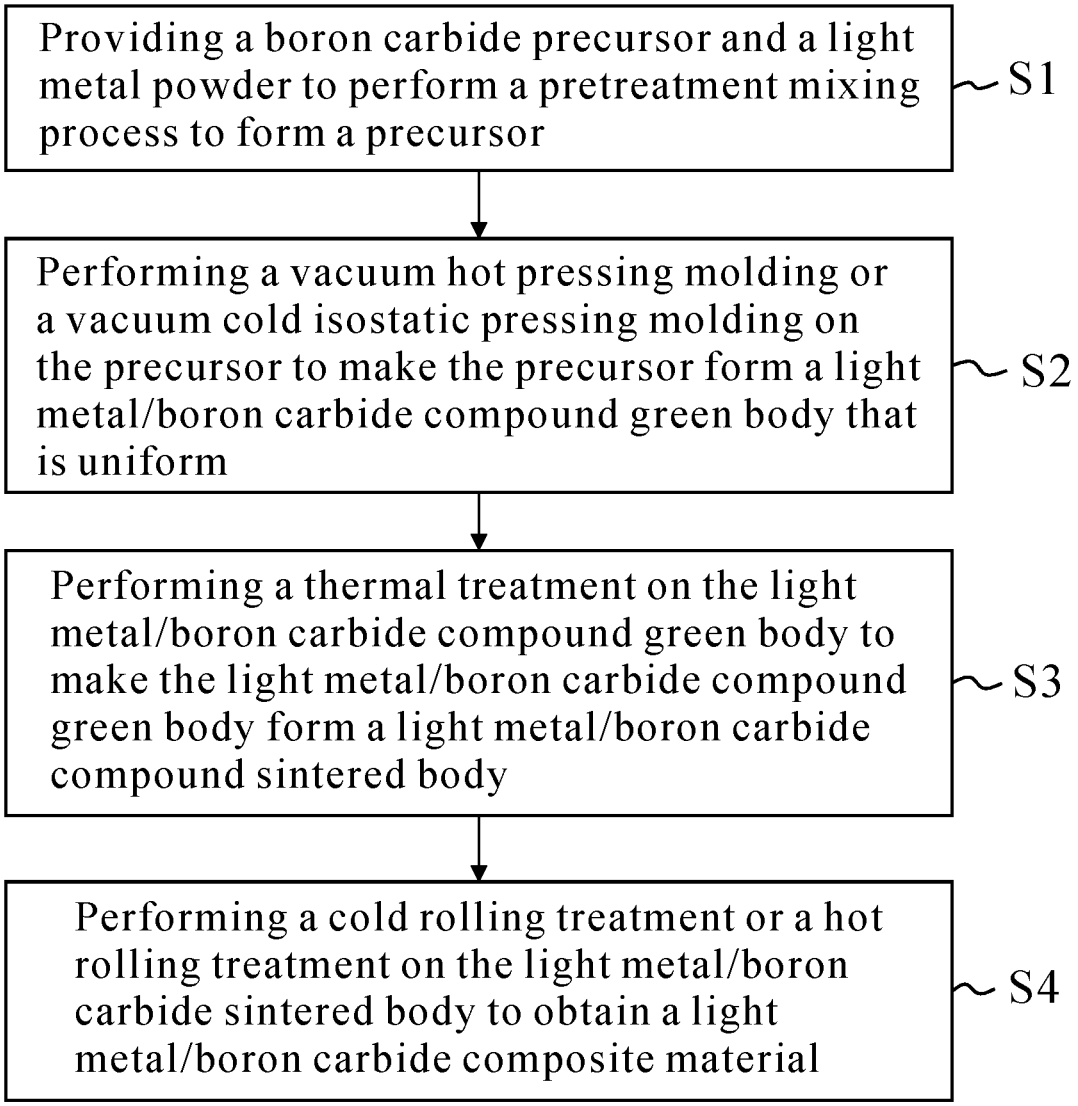
Providing a boron carbide precursor and a light metal powder to perform a pretreatment mixing process to form a precursor
S1
Performing a vacuum hot pressing molding or a vacuum cold isostatic pressing molding on the precursor to make the precursor form a light metal/boron carbide compound green body that is uniform
S2
Performing a thermal treatment on the light metal/boron carbide compound green body to make the light metal/boron carbide compound green body form a light metal/boron carbide compound sintered body
S3
Performing a cold rolling treatment or a hot rolling treatment on the light metal/boron carbide sintered body to obtain a light metal/boron carbide composite material
S4

PREPARATION METHOD OF LIGHT METAL/BORON CARBIDE COMPOSITE MATERIAL

BACKGROUND OF THE INVENTION

1. Field of the Invention

The present invention relates to a preparation method of a light metal/boron carbide composite material, and in particular to a preparation method of a light metal/boron carbide composite material having low thermal expansion coefficient, high strength, light weight, low density, high toughness and good friction and wear performance.

2. Description of the Related Art

One of the known lightweight metal alloy structures has high specific strength and specific stiffness, excellent damping, good electromagnetic compatibility and easy processing, and can be widely used in aerospace fields. However, the light metal of prior arts has low strength and insufficient plasticity. Its strength is only about 50 to 70% of that of metal-based composites, which limits the application range of light metals. Moreover, light metal composites can supplement the deficiencies of light metals in this regard.

Light metal/boron carbide composite materials are ceramic materials with light weight and high hardness, wherein the hardness of boron carbide is second only to diamond and cubic boron nitride in nature, especially the high temperature hardness that is nearly constant (>30 GPa). In boron carbide, boron and carbon are mainly combined by covalent bonds. Boron carbide has the characteristics of high melting point (2450° C.), high hardness, low density (2.52 g/cm$^3$), good wear resistance and strong acid and alkali resistance. However, pure boron carbide itself has the disadvantages of low fracture toughness, too high sintering temperature and poor stability. With the development of ceramic composite material technology, special sintering to compound light metals with boron carbide has become possible. The important application aspects of boron carbide composite materials include: electronic components, lightweight machine exoskeletons and vibration membrane materials.

Alyn Company of the United States successfully develops a boron carbide reinforced aluminum-based composite material with extremely high specific stiffness and elastic modulus of up to 100 MPa, which was named "Boralyn". Such material has a low density, has been used in aircraft landing gear and ventilated brake discs, is mainly composed of the particle-reinforced aluminum-based composite material, and is 50% lighter than the conventional product.

Light metal-based composite materials have excellent physical properties such as light weight, high specific strength and good wear resistance. It will be widely used in aerospace, military and automotive industries. Among them, the particle-reinforced metal-based composite material has the characteristics of low cost and simple preparation process, and has gradually become the research focus in the field of fine metal-based composites in the domestic and foreign countries.

The preparation method of conventional magnesium-based composite material comprises the following steps. The magnesium-based metal is provided and then stirred to become the semi-solid magnesium-based metal. Afterwards, the nano-scale reinforcing phase particles are added to obtain the semi-solid mixture. The semi-solid mixed paste described above is heated to become a liquid mixed paste, which is then ultrasonically treated and cooled to obtain a magnesium-based composite material with a specific stiffness of 2.

The conventional method of adding ceramic particle enhancers to the aluminum alloy improves the strength of the aluminum-based composite material, and the nano-scale ceramic particles can be uniformly dispersed in the aluminum-based metal, which can effectively refine the grains of the light metal, thereby increasing the material strength. Previous nano-scale enhancers include silicon carbide, aluminum oxide, boron carbide, titanium carbide and yttrium oxide. The boron carbide reinforced aluminum metal-based composite material is produced by microwave sintering, and the powder is mixed with high-speed mixing in the process, so that it has a higher grain refinement effect. The sintering by microwave irradiation can promote the uniform dispersion of boron carbide particles in the aluminum-based material and facilitates the improvement of the interface bonding between the $B_4C$ particles and the Al matrix, thereby enhancing the comprehensive performance.

Conventionally, a powder metallurgy method is used to prepare the 10% by weight boron carbide aluminum-based composite material. Compared with the SiC reinforcing phase, the boron carbide composite material has better wear resistance and other mechanical properties. In the conventional powder metallurgy reaction process, if $B_2O_3$ is in a liquid phase at a high temperature, it will become a compatible state with the $Al_2O_3$ film on the surface of the aluminum matrix, which improves the wettability at the interface, and the effectively discharging pores also improve the interface bonding.

The performance of ceramic particles reinforced light metal-based composites is greatly related to the dispersibility of ceramic particles due to the easy agglomeration of the fine particles and the resulting greatly reduced enhancement effect of ceramic particles. Therefore, how to improve the downside of the light metal boron carbide composites is the focus of the research.

Therefore, how to contemplate a preparing method of a light metal/ceramic composite material with low cost, high strength, lightweight performance and eligibility for industrial production is an urgent problem to be solved. The light metal/silicon carbide composite material of the prior art has low elastic strength and insufficient plasticity. However, the light metal/boron carbide composite material can make up for the deficiencies of the light metal/silicon carbide composite material in this aspect.

To sum up, the preparation method of the light metal/ceramic composite material still has deficiencies at present, so the applicant of the present application has developed a preparation method of a light metal/boron carbide composite material through painstaking research, thereby effectively solving the problems due to low elastic strength and insufficient plasticity.

BRIEF SUMMARY OF THE INVENTION

In view of the above deficiencies of the prior arts, a main object of the present invention is to provide a preparation method of a light metal/boron carbide composite material, which has the advantages of low thermal expansion coefficient, high strength, light weight, low density, high toughness, good friction and wear performance, etc. The preparation method is simple to operate, has low cost of raw materials and high production efficiency, is suitable for industrial production, and can be applied to electronic components, mechanical exoskeleton and vibrating membrane, etc.

To achieve the above object, an aspect of the present invention provides a preparation method of a light metal/boron carbide composite material, comprising: (A) providing a boron carbide precursor and a light metal powder to perform a pretreatment mixing process to form a precursor; (B) performing a vacuum hot pressing molding or a vacuum cold isostatic pressing molding on the precursor to make the precursor form a light metal/boron carbide compound green body that is uniform; (C) performing a thermal treatment on the light metal/boron carbide compound green body to make the light metal/boron carbide compound green body form a light metal/boron carbide compound sintered body; and (D) performing a cold rolling treatment or a hot rolling treatment on the light metal/boron carbide compound sintered body to obtain a light metal/boron carbide composite material.

Another object of the present invention is to make the particles more closely combine with the metal matrix interface under the action of external pressure, reduce the diffusion energy, improve the interface bonding degree and increase the diffusion effect without destroying the strength of the reinforcing particles at the same time through the isostatic pressing treatment and microwave irradiation process, which can greatly improve the performance of the composite materials, compared with the conventional sintering.

Preferably, the boron carbide precursor includes boron carbide and/or a mixture of h-boron nitride and carbon black, a mixture of boron oxide and carbon black or a combination thereof, wherein a weight percent of boron carbide is more than or equal to 50%.

Preferably, the boron carbide precursor comprises 1 wt % to 50 wt % of boron oxide and 0.1 to 5 wt % of carbon black, and/or 1 wt % to 49 wt % of h-boron nitride and 1 to 4.9 wt % of carbon black.

Preferably, the light metal powder is selected from aluminum powder, magnesium powder, titanium powder and a combination thereof, wherein the aluminum powder, magnesium powder, and titanium powder can be spherical or flake-like, and the light metal powder has an average particle size of 1 to 100 microns.

Preferably, the boron carbide precursor has an average particle size of less than or equal to 100 microns.

Preferably, the pretreatment mixing process of step (A) uses a high-speed mixer, which has a rotation speed of more than or equal to 300 rpm and a running time of more than or equal to 1 min, for mixing.

Preferably, the vacuum cold isostatic pressing molding puts the precursor into a vacuum package mold for proceeding with a cold isostatic pressing process, so that the precursor is molded by isostatic pressing to form the light metal/boron carbide compound green body.

Preferably, the cold isostatic pressing molding uses a molding pressure of more than or equal to 3000 kgf/cm$^2$.

Preferably, the vacuum hot pressing molding uses a pressure of more than or equal to 200 kgf/cm$^2$, an operation temperature of more than or equal to 500° C., an operation time of more than or equal to 60 minutes and a vacuum degree of more than or equal to $1\times10^{-2}$ torr.

Preferably, the thermal treatment uses a vacuum microwave irradiation or a vacuum thermal treatment temperature of more than or equal to 600° C., wherein the microwave irradiation uses a microwave output power of more than or equal to 1950 W and a microwave irradiation time between 1 and 14 hours.

Preferably, the hot rolling treatment uses a hot rolling temperature of more than or equal to 500° C.

The treatment of step (D) is a cold rolling treatment or a hot rolling treatment, wherein the cold rolling treatment or the hot rolling treatment increases the degree of densification.

The above summary, the following detailed description and the accompanying drawings are all for the purpose of further illustrating the manner, means and effect adopted by the present invention to achieve the predetermined object. Other objects and advantages of the present invention will be set forth in the following descriptions and drawings.

BRIEF DESCRIPTION OF THE DRAWINGS

FIG. 1 is a flow chart showing a preparation method of a light metal/boron carbide composite material of the present invention.

DETAILED DESCRIPTION OF THE INVENTION

The following describes the embodiments of the present invention with specific examples, and those skilled in the art can easily understand the advantages and effects of the present creation from the content disclosed in the specification.

Please refer to FIG. 1, which is a flow chart showing a preparation method of a light metal/boron carbide composite material of the present invention. One of the solutions proposed by the present invention provides a preparation method of a light metal/boron carbide composite material. The steps comprises: step S1 provides a boron carbide precursor and a light metal powder to perform a pretreatment mixing process to form a precursor, step S2 performs a vacuum hot pressing molding or a vacuum cold isostatic pressing molding on the precursor to make the precursor form a light metal/boron carbide compound green body that is uniform, step S3 performs a thermal treatment on the light metal/boron carbide compound green body to make the light metal/boron carbide compound green body form a light metal/boron carbide compound sintered body, and then step S4 performs a cold rolling treatment or a hot rolling treatment (the hot rolling temperature ≥500° C.) on the light metal/boron carbide compound sintered body to obtain a light metal/boron carbide composite material.

In the present embodiment, step S1 provides the boron carbide precursor and the light metal powder to perform the pretreatment mixing process to form the precursor. The boron carbide precursor includes boron carbide and/or a mixture of h-boron nitride and carbon black, a mixture of boron oxide and carbon black or a combination thereof, wherein the weight percent of boron carbide is more than or equal to 50%. The boron carbide precursor comprises 1 wt % to 49 wt % of boron oxide and 0.1 to 4.9 wt % of carbon black, and/or 1 wt % to 49 wt % of h-boron nitride and 1 to 4.9 wt % of carbon black. The boron carbide precursor has an average particle size of less than or equal to 100 microns.

In the present embodiment, the light metal powder is selected from aluminum powder, magnesium powder, titanium powder and a combination thereof, wherein the aluminum powder, magnesium powder, and titanium powder can be spherical or flake-like, and the light metal powder has an average particle size of 1 to 100 microns.

In the present embodiment, step S2 proceeds with the vacuum hot pressing molding or the vacuum cold isostatic pressing molding to make the precursor form the uniform light metal/boron carbide compound green body, and the pretreatment mixing process of step S1 uses the high-speed mixer for mixing. The rotation speed is more than or equal to 300 rpm, and the running time is more than or equal to 1 minute.

In the present embodiment, the vacuum cold isostatic pressing molding puts the precursor into the vacuum package mold for proceeding with the cold isostatic pressing process, and the molding pressure of the cold isostatic pressing molding is more than or equal to 3000 kgf/cm$^2$.

In the present embodiment, the pressure of the vacuum hot pressing molding is more than or equal to 200 kgf/cm$^2$, the operation temperature is more than or equal to 500° C., the operation time is more than or equal to 60 minutes and the vacuum degree is more than or equal to $1\times10^{-2}$ torr.

In the present embodiment, step S3 performs the thermal treatment process to form the light metal/boron carbide compound sintered body, and the thermal treatment process uses the microwave irradiation or vacuum thermal treatment temperature of more than or equal to 600° C., in which the microwave output power of the microwave irradiation is more than or equal to 1950 W, the vacuum microwave irradiation time is between 1 and 14 hours, and the vacuum degree is above $1\times10^{-2}$ torr.

The embodiment of the preparation method proposed by the present invention provides a preparation method of the aluminum/boron carbide composite material. The steps may comprise: first, the boron carbide precursor containing 90 wt % of boron carbide, 9 wt % of boron oxide compound and 0.9 wt % of carbon black (in the embodiment of the present invention, the weight percent of boron carbide may be 90 wt %, into which 5 wt % to 10 wt % of boron oxide and 1-4.9 wt % of carbon black are added) is mixed for 1 to 4 hours through high speed ball milling to form the boron carbide precursor. The boron carbide precursor of this embodiment may include boron carbide and/or the mixture of h-boron nitride and carbon black, the mixture of boron oxide and carbon black or a combination thereof. Next, the boron carbide precursor and the aluminum powder perform the pretreatment mixing process to mix and form the precursor. Next, the precursor is put into the vacuum package, which is then put in the fixed polymer mold to carry out the cold isostatic pressing process, thereby forming the aluminum/boron carbide compound green body. The parameter of the molding machine is set to have a pressure of more than or equal to 3000 kgf/cm$^2$. Next, the aluminum/boron carbide compound green body is heated to a temperature above 600° C., and the calcination time is at least 1 hour for vacuum sintering (the heat treatment equipment for vacuum sintering may be a microwave calcination furnace or a vacuum calcination furnace), so as to make the aluminum/boron carbide compound green body transform into the boron carbide crystalline phases and obtain the aluminum/boron carbide composite material, contributing to better bonding.

To sum up, the preparation method of the light metal/boron carbide composite material of the present invention has the following advantages. (1) The present invention is also a precursor conversion method, which can replace part of boron carbide as a raw material, and can reduce the cost of raw materials. Another object uses light metal as an interface for catalytic reaction. Through the cold isostatic pressing process, the precursor can be heated and then cooled to form a uniform solid to synthesize and manufacture the light metal/boron carbide composite material. The advantage of cold isostatic pressing or hot pressing is that it can increase the contact area and uniformity of the powder. Through use of aluminum or magnesium metal as the catalytic medium, the boron carbide precursor can be catalyzed and transformed into boron carbide, which can improve the uniformity of the cracking reaction and reduce the cost of raw materials, and then the heat treatment through microwave irradiation may be carried out. (2) The light metal/boron carbide composite material of the present invention has simple operation of the preparation method, low raw material cost, indirect use of boron carbide as a precursor, and improved densification degree through microwave irradiation and cold rolling treatment, which is suitable for industrial production. The light metal/boron carbide composite material obtained by the preparation method of the present invention has the advantages of high strength, light weight, high toughness, good friction and wear performance and the like.

The embodiments described above are only illustrative of the features and efficacies of the present invention, and are not intended to limit the scope of the essential technical content of the present invention. Anyone skilled in the art can modify and change the above-mentioned embodiments without departing from the spirit and scope of the present invention. Therefore, the protection scope of the present invention should be determined by the appended claims.

What is claimed is:

1. A preparation method of a light metal/boron carbide composite material, comprising:

(A) providing a boron carbide precursor and a light metal powder to perform a pretreatment mixing process to form a precursor, wherein the light metal powder acts as a catalytic medium so that the boron carbide precursor is catalyzed by the light metal powder;

(B) performing a vacuum cold isostatic pressing molding on the precursor to make the precursor form a light metal/boron carbide compound green body that is uniform;

(C) performing a thermal treatment on the light metal/boron carbide compound green body to make the light metal/boron carbide compound green body form a light metal/boron carbide compound sintered body; and (D) performing a cold rolling treatment or a hot rolling treatment on the light metal/boron carbide compound sintered body to obtain a light metal/boron carbide composite material, wherein the carbide precursor includes a mixture of h-boron nitride and carbon black and/or a mixture of boron oxide and carbon black, wherein the boron carbide precursor comprises 1 wt % to 49 wt % of boron oxide and 0.1 to 4.9 wt % of carbon black, and/or 1 wt % to 49 wt % of h-boron nitride and 1 to 4.9 wt % of carbon black, wherein the light metal powder is selected from aluminum powder, magnesium powder and a combination thereof, wherein the cold isostatic pressing molding uses a molding pressure of more than or equal to 3000 kgf/cm$^2$, and wherein the thermal treatment uses a vacuum microwave irradiation or a vacuum thermal treatment temperature of more than or equal to 600° C.

2. The preparation method of a light metal/boron carbide composite material of claim 1, wherein the aluminum powder and magnesium powder are spherical, and the light metal powder has an average particle size of 1 to 100 microns.

3. The preparation method of a light metal/boron carbide composite material of claim 1, wherein the pretreatment mixing process of step (A) uses a high-speed mixer, which has a rotation speed of more than or equal to 300 rpm and a running time of more than or equal to 1 minute, for mixing.

4. The preparation method of a light metal/boron carbide composite material of claim 1, wherein the vacuum cold isostatic pressing molding puts the precursor into a vacuum package mold for proceeding with a cold isostatic pressing process, so that the precursor is molded by isostatic pressing to form the light metal/boron carbide compound green body.

5. The preparation method of a light metal/boron carbide composite material of claim 1, wherein the microwave irradiation uses a microwave output power of more than or equal to 1950 W, a microwave irradiation time between 1 and 14 hours, and a vacuum degree of more than or equal to $1\times10^{-2}$ torr.

6. The preparation method of a light metal/boron carbide composite material of claim 1, wherein the hot rolling treatment uses a hot rolling temperature of more than or equal to 500° C.

* * * * *